US010103497B2

(12) United States Patent
Tsang et al.

(10) Patent No.: US 10,103,497 B2
(45) Date of Patent: Oct. 16, 2018

(54) GROUNDING CONNECTOR HAVING COMPLIANT GROUNDING CONTACTS

(71) Applicant: TYCO ELECTRONICS CORPORATION, Berwyn, PA (US)

(72) Inventors: Albert Tsang, Harrisburg, PA (US); Kevin Michael Thackston, York, PA (US); Dustin Carson Belack, Hummelstown, PA (US); Kyle Gary Annis, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/230,942

(22) Filed: Aug. 8, 2016

(65) Prior Publication Data

US 2018/0040986 A1 Feb. 8, 2018

(51) Int. Cl.

*H01R 13/648* (2006.01)
*H01R 13/41* (2006.01)
*H01R 13/52* (2006.01)

(52) U.S. Cl.

CPC ..... *H01R 13/648* (2013.01); *H01R 13/41* (2013.01); *H01R 13/521* (2013.01)

(58) Field of Classification Search

CPC ..... H01R 13/5219; H01R 23/02; H01R 13/6597; H01R 13/65805; H01R 12/585; H01R 13/6505

USPC ..... 439/271, 660, 751, 101, 931, 825

See application file for complete search history.

(56) References Cited

U.S. PATENT DOCUMENTS 3,670,292 A 6/1972 Tracy
3,721,943 A * 3/1973 Curr ..... H01R 13/426 439/273
3,786,396 A * 1/1974 Kemmer ..... H01R 13/621 439/321
4,611,873 A 9/1986 Punako et al.
5,215,473 A 6/1993 Brunker et al.
5,292,256 A * 3/1994 Brunker ..... H01R 13/65802 439/108
5,662,488 A * 9/1997 Alden ..... H01R 13/625 439/314

(Continued)

FOREIGN PATENT DOCUMENTS

GB 1 489 853 A 10/1977
JP 2008 243566 A 10/2008

OTHER PUBLICATIONS

European Search Report, dated Oct. 16, 2017, EP 17 18 4157, Application No. 17184157.0-1801.

*Primary Examiner* — Tulsidas C Patel
*Assistant Examiner* — Marcus Harcum

(57) ABSTRACT

A grounding connector includes a shell having a mating end and a mounting end. The shell defines a cavity open at the mating end configured to receive a mating component. The shell has a base at the mounting end having a plurality of contact channels open to the cavity. Grounding contacts are received in corresponding contact channels. The grounding contacts have mating ends and compliant portions opposite the mating ends. The mating ends are positioned in the cavity for mating with the mating component. The compliant portions are received in the contact channels to mechanically and electrically connect each of the grounding contacts to the shell and to each other through the shell.

20 Claims, 4 Drawing Sheets

(56) References Cited

U.S. PATENT DOCUMENTS

| | | | | |
|---|---|---|---|---|
| 5,915,999 | A * | 6/1999 | Takenaka | H01R 12/585 439/751 |
| 7,083,434 | B1 * | 8/2006 | Blossfeld | H01R 12/585 200/284 |
| 7,422,486 | B2 * | 9/2008 | Hoff | G06F 3/023 439/655 |
| 7,753,726 | B2 * | 7/2010 | Malstrom | H01R 24/52 439/581 |
| 8,888,541 | B2 * | 11/2014 | Endo | H01R 12/585 439/751 |
| 2008/0311779 | A1 * | 12/2008 | Brassell | H01R 13/5202 439/345 |
| 2009/0311910 | A1 * | 12/2009 | Kleinke | H01R 9/03 439/607.51 |
| 2010/0035452 | A1 * | 2/2010 | Mudge, III | H01R 13/533 439/271 |
| 2011/0287667 | A1 * | 11/2011 | Ichio | H01R 13/4367 439/660 |
| 2013/0102201 | A1 * | 4/2013 | Montena | H01R 12/70 439/660 |
| 2013/0194769 | A1 * | 8/2013 | Belack | F41G 11/003 361/807 |
| 2015/0288108 | A1 * | 10/2015 | Fischer | H01R 13/5219 439/88 |

* cited by examiner

GROUNDING CONNECTOR HAVING COMPLIANT GROUNDING CONTACTS

BACKGROUND OF THE INVENTION

The subject matter herein relates generally to grounding connectors.

Some electrical connectors are used for grounding various components. For example, grounding connectors use grounding contacts to electrically common the grounding connector with another component, such as a mating connector. The body or shell of the grounding connector may also be used to electrically common the grounding connector with the other component. The grounding connectors typically include an outer shell and an insert received in the outer shell. The insert holds a plurality of grounding contacts or pins, which are electrically commoned by a base plate or printed circuit board, or alternatively, the insert is manufactured as a single component, such as through a cold forming or machining process.

Such grounding connectors are not without problems. For example, the pins are typically soldered or laser welded to the base plate or the printed circuit board. However, soldering may be undesirable in some circumstances, such as when using plated components as the soldering process cannot be used with certain plating chemistries. Additionally, laser welding is restrictive in some circumstances, such as relating to compatibility of certain metals attempted to be joined by laser welding. Moreover, grounding connectors formed using cold forming contacts into one component requires expensive tooling which cannot be changed, such as when pin sizing, pin spacing, or other design features are needed to be changed. Moreover, machining the pins into a single component requires a large amount of time and material removal. Such techniques are expensive and time-consuming.

BRIEF DESCRIPTION OF THE INVENTION

In one embodiment, a grounding connector includes a shell having a mating end and a mounting end. The shell defines a cavity open at the mating end configured to receive a mating component. The shell has a base at the mounting end having a plurality of contact channels open to the cavity. Grounding contacts are received in corresponding contact channels. The grounding contacts have mating ends and compliant portions opposite the mating ends. The mating ends are positioned in the cavity for mating with the mating component. The compliant portions are received in the contact channels to mechanically and electrically connect each of the grounding contacts to the shell and to each other through the shell.

In another embodiment, a grounding connector is provided including a shell having a mating end and a mounting end. The shell has a cylindrical body at the mating end defining a cavity open at the mating end configured to receive a mating component. An exterior of the cylindrical body is threaded. The shell has a base at the mounting end and a mounting flange extending from the base. The base has a plurality of contact channels open to the cavity. Grounding contacts are received in corresponding contact channels. The grounding contacts have mating ends and compliant portions opposite the mating ends. The mating ends are positioned in the cavity for mating with the mating component. The compliant portions are received in the contact channels to mechanically and electrically connect each of the grounding contacts to the shell and to each other through the shell.

In a further embodiment, a grounding connector is provided including a shell having a mating end and a mounting end. The shell defines a cavity open at the mating end configured to receive a mating component. The shell has a base at the mounting end having a plurality of contact channels open to the cavity. The shell holds an interfacial seal in the cavity at the base. The interfacial seal has contact openings aligned with corresponding contact channels. Grounding contacts are received in corresponding contact channels. The grounding contacts have mating ends and compliant portions opposite the mating ends. The mating ends extend forward of the base into the cavity for mating with the mating component. The mating ends pass through the contact openings in the interfacial seal such that the interfacial seal seals to each of the grounding contacts. The compliant portions are received in the contact channels to mechanically and electrically connect each of the grounding contacts to the shell and to each other through the shell.

DETAILED DESCRIPTION OF THE INVENTION

Figure 1:
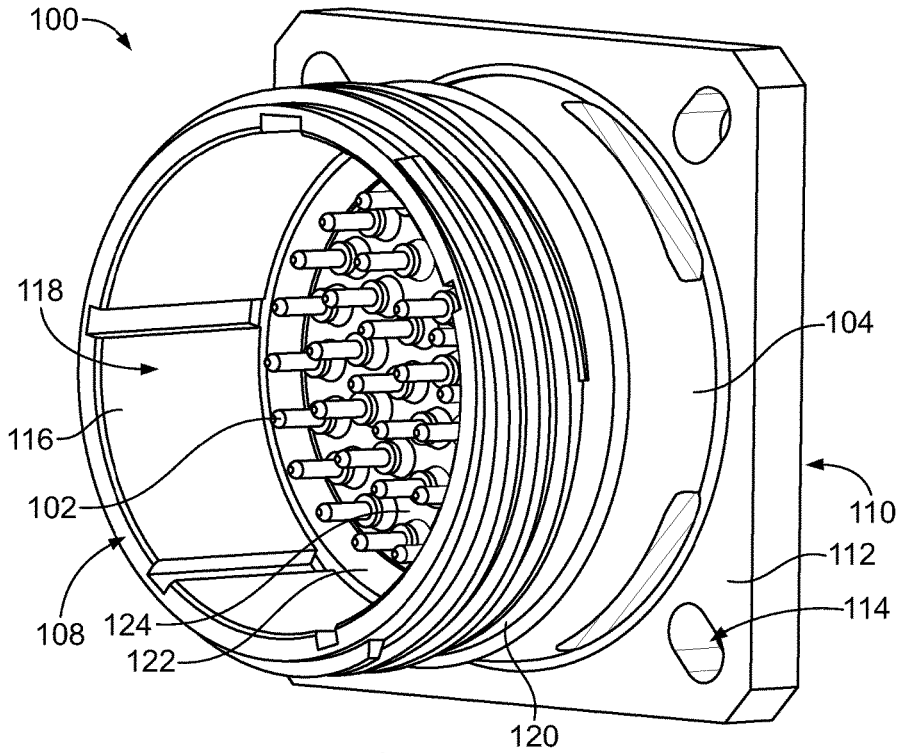
FIG. 1 is a front perspective view of a grounding connector formed in accordance with an exemplary embodiment.
Figure 2:
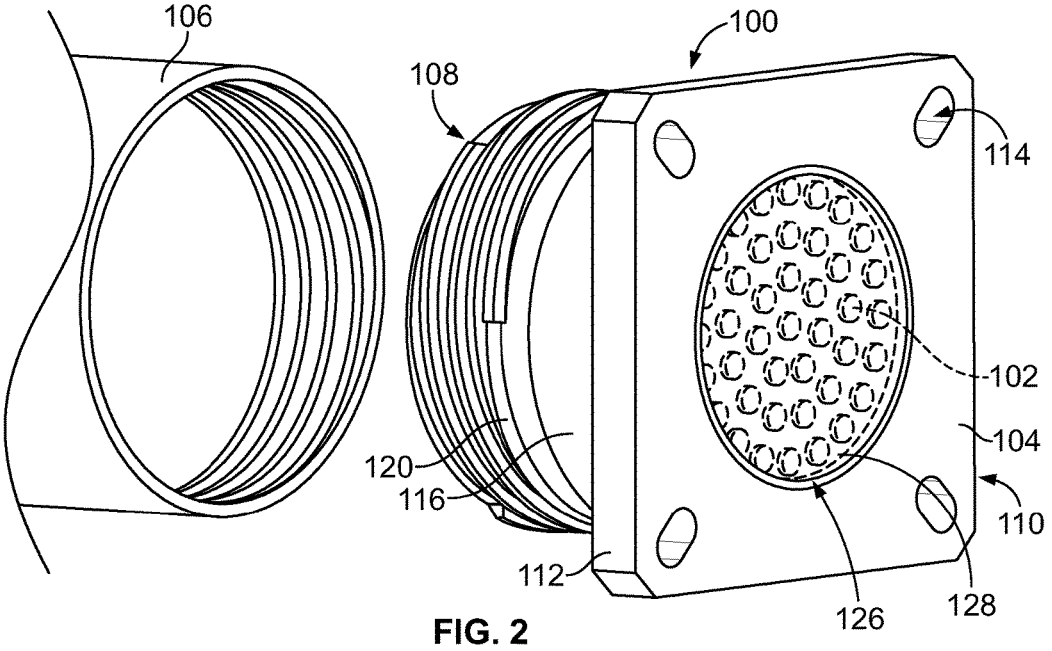
FIG. 2 is a rear perspective view of the grounding connector.

FIG. 1 is a front perspective view of a grounding connector 100 formed in accordance with an exemplary embodiment. FIG. 2 is a rear perspective view of the grounding connector 100. The grounding connector 100 includes a plurality of grounding contacts 102 configured to be electrically commoned and electrically grounded. The grounding connector 100 includes a shell 104 holding the grounding contacts 102. In an exemplary embodiment, the shell 104 is conductive and electrically connected to the grounding contacts 102 to ground the shell 104. The shell 104 may be manufactured from a metal material, such as a die cast part. In other various embodiments, the shell 104 may be a metallized plastic shell, such as a plated shell or a plastic shell having metal particles embedded therein.

In an exemplary embodiment, the grounding contacts 102 physically engage the shell 104 to electrically connect to the shell 104. In an exemplary embodiment, the grounding contacts 102 are press-fit into the shell using compliant portions of the grounding contacts 102. For example, the grounding contacts 102 may include eye-of-the-needle pins press-fit into the shell 104. In an exemplary embodiment, the grounding contacts 102 are machined contacts; however, the grounding contacts 102 may be other types of contacts, such as stamped and formed contacts. The grounding contacts 102 may be separately manufactured from each other and separately loaded into the shell 104.

The grounding connector 100 may have any size or shape for connecting to a mating component 106 (shown schematically in FIG. 2). In the illustrated embodiment, the grounding connector 100 is a circular connector having a high density contact layout. In an exemplary embodiment, the grounding connector 100 is an MIL-DTL-38999 type of connector conforming to the MIL-DTL-38999 specifications, such as having a mating interface conforming to the MIL-DTL-38999 specifications. However, the grounding connector 100 may be another type of connector and may conform to another specification.

The shell 104 has a mating end 108 and a mounting end 110. The mating end 108 is provided at a front of the grounding connector 100 and the mounting end 110 is provided at a rear of the grounding connector 100. The mounting end 110 includes a mounting flanges 112 used for mounting the grounding connector 100 to another structure. For example, the mounting flanges 112 may extend around the perimeter of the grounding connector 100 and include openings 114 configured to receive fasteners (not shown) for securing the grounding connector 100 to the structure.

In an exemplary embodiment, the shell 104 includes a cylindrical body 116 at the mating end 108 defining a cavity 118. The body 116 may have other shapes other than a cylindrical shape in alternative embodiments. The cavity 118 is open at the mating end 108 to receive the mating component 106. For example, a portion of the mating component 106 may be plugged into the cavity 118 for mating with the grounding contacts 102. In the illustrated embodiment, the cavity 118 is cylindrical; however, the cavity 118 may have other shapes in alternative embodiments. In an exemplary embodiment, an exterior 120 of the cylindrical body 116 is threaded, such as for mating with the mating component 106. Alternatively, an interior of the cylinder body 116 may be threaded. In other various embodiments, the grounding connector 100 may include other types of securing means for securing the mating component 106 to the grounding connector 100, such as latches, clips, fasteners, and the like.

In an exemplary embodiment, the grounding connector 100 includes a perimeter seal 122 for sealing with the mating component 106. For example, the perimeter seal 122 may be a ring seal received in the cavity 118, such as at the bottom of the cavity 118. The perimeter seal 122 may be compressible, such as against the mating component 106 when the mating component 106 is mated with the grounding connector 100. In an exemplary embodiment, the grounding connector 100 includes an interfacial seal 124 for sealing against the grounding contacts 102. For example, the interfacial seal 124 may be received in the cavity 118, such as at the bottom of the cavity 118. The grounding contacts 102 may pass through the interfacial seal 124 such that the interfacial seal 124 seals against each of the grounding contacts 102.

In an exemplary embodiment, the shell 104 includes a pocket 126 at the mounting end 110. The grounding contacts 102 may be loaded into the shell 104 through the pocket 126. The pocket 126 may be sealed with a rear pocket seal 128 after the grounding contacts 102 are loaded into the shell 104. In alternative embodiments, the grounding contacts 102 may be loaded into the shell 104 through the front, such as through the cavity 118. In such embodiments, the rear of the shell 104 may be solid and have no need for a seal at the mounting end 110.

Figure 3:
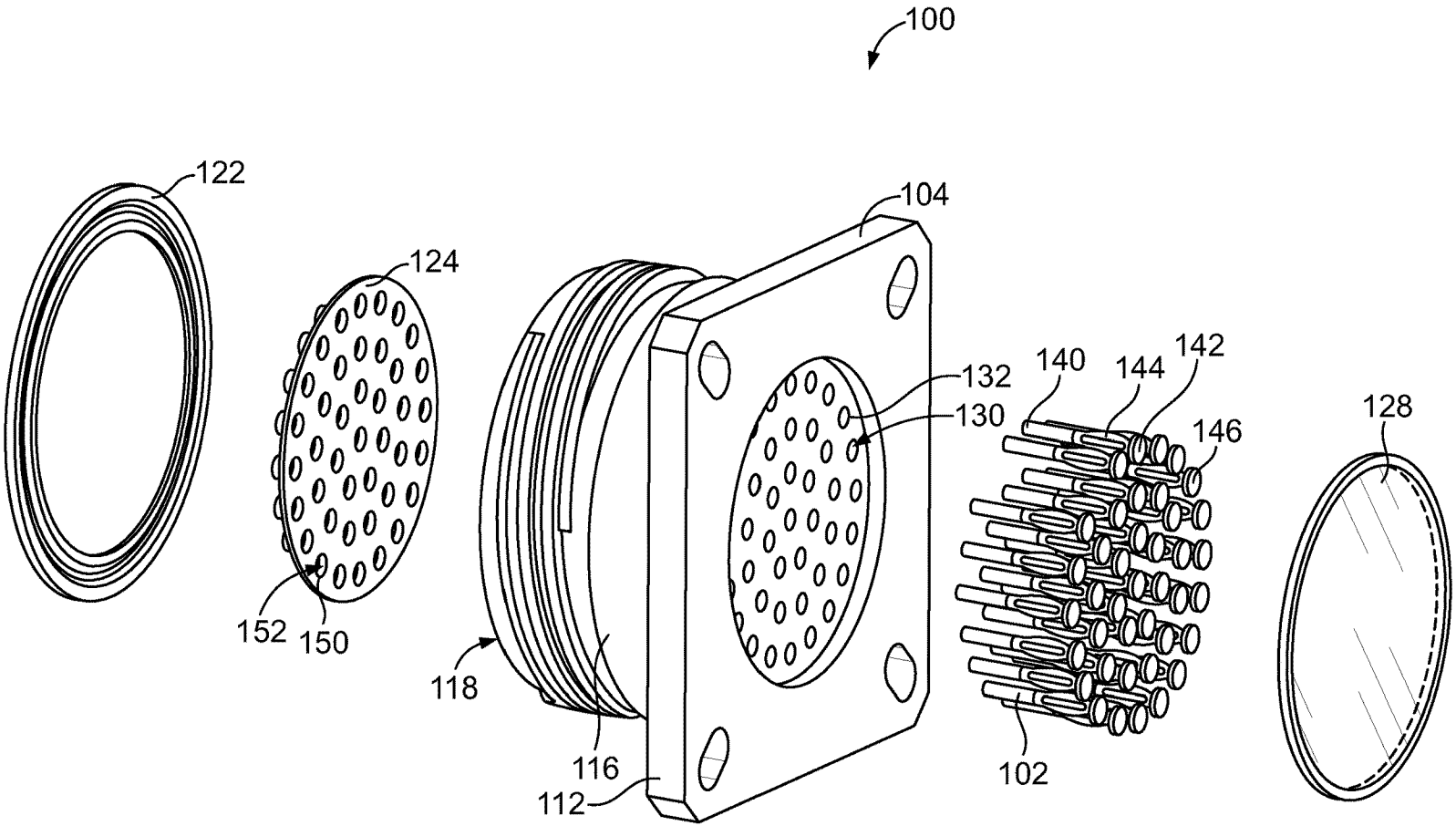
FIG. 3 is an exploded view of the grounding connector formed in accordance with an exemplary embodiment.

FIG. 3 is an exploded view of the grounding connector 100 formed in accordance with an exemplary embodiment. FIG. 3 illustrates the shell 104 showing the grounding contacts 102 poised for loading into the shell 104, such as from the rear of the shell 104. FIG. 3 also illustrates the rear pocket seal 128 used to seal the grounding contacts 102 in the shell 104 as well as the interfacial seal 124 used to seal the grounding contacts 102 in the shell 104. The perimeter seal 122 is shown poised for loading into the shell 104.

In an exemplary embodiment, the shell 104 includes a plurality of contact channels 130 formed in a base 132 of the shell 104 at the rear of the shell 104. The contact channels 130 are configured to receive corresponding grounding contacts 102. Each contact channel 130 receives a single grounding contact 102. The base 132 defined the bottom of the cavity 118 with the cylindrical body 116 extending forward of the base 132. The mounting flange 112 extends outward from the base 132, such as in one or more directions from the base 132. In an exemplary embodiment, the contact channels 130 extend entirely through the base 132 such that the grounding contacts 102 may extend from the base 132 into the cavity 118. As such, the grounding contacts 102 may be rear loaded into the shell 104 from behind the base 132 with mating portions of the ground contacts 102 exposed inside the cavity 118 for mating with the mating component 106 (FIG. 1).

The contact channels 130 are arranged in an array around the base 132 two spaced the grounding contacts 102 apart from each other. In an exemplary embodiment, the contact channels 130, and thus the grounding contacts 102, may have a tight spacing to provide a high density of the grounding contacts 102 within the grounding connector 100. Optionally, each of the contact channels 130 may be approximately equally distant from each of the nearest contact channels 130 to provide a general equal spacing between the grounding contacts 102. The contact channels 130 are arranged in a circular array in the illustrated embodiment; however, the contact channels 130 may have other patterns in alternative embodiments.

The grounding contacts 102 have mating ends 140 and rear ends 142 opposite the mating ends 140. Each grounding contact 102 includes a compliant portion 144 configured to be received in the corresponding contact channel 130 to mechanically and electrically connect the grounding contact 102 to the shell 104. In an exemplary embodiment, the compliant portions 144 are at or near the rear ends 142.

Optionally, as in the illustrated embodiment, the grounding contacts 102 include flanges 146 at or near the rear ends 142 for locating the grounding contacts 102 relative to the shell 104. For example, the grounding contacts 102 may be loaded into the contact channels 130 until the flanges 146 bottom out against the base 132. The compliant portions 144 are immediately forward of the flanges 146 such that the compliant portions 144 are located in the contact channels 130 when the flanges 146 engage the base 132.

However, in alternative embodiments, the grounding contacts 102 may be devoid of the flanges 146, rather relying on other components or features to locate the grounding contacts 102 within the shell 104. For example, the grounding contacts 102 may be staffed, with one or more of the steps bottoming out against a portion of the shell 104, such as within the contact channels 130. In other various embodiments, the flanges 146 may be provided forward of the compliant portions 144. For example, such grounding contacts may be front loaded into the contact channels 130 from the front of the base 132 rather than from behind the base 132.

The mating ends 140 of the grounding contacts 102 are configured to be mated with the mating component 106. In the illustrated embodiment, the mating ends 140 are pins;

however, other types of mating ends may be provided in alternative embodiments, such as sockets, blades, spring beams, or other types of mating ends.

The interfacial seal 124 includes a disk shaped body 150 sized and shaped to fit in the cavity 118 of the shell 104. The interfacial seal 124 includes a plurality of contact openings 152 for receiving corresponding ground contacts 102. The contact openings 152 are configured to be aligned with corresponding contact channels 130 such that the grounding contacts 102 may be loaded through the contact openings 152 as the grounding contacts 102 are loaded into the shell 104. The mating ends 140 of the grounding contacts 102 pass through the contact openings 152 such that the interfacial seal 124 seals to each of the grounding contacts 102.

Figure 4:
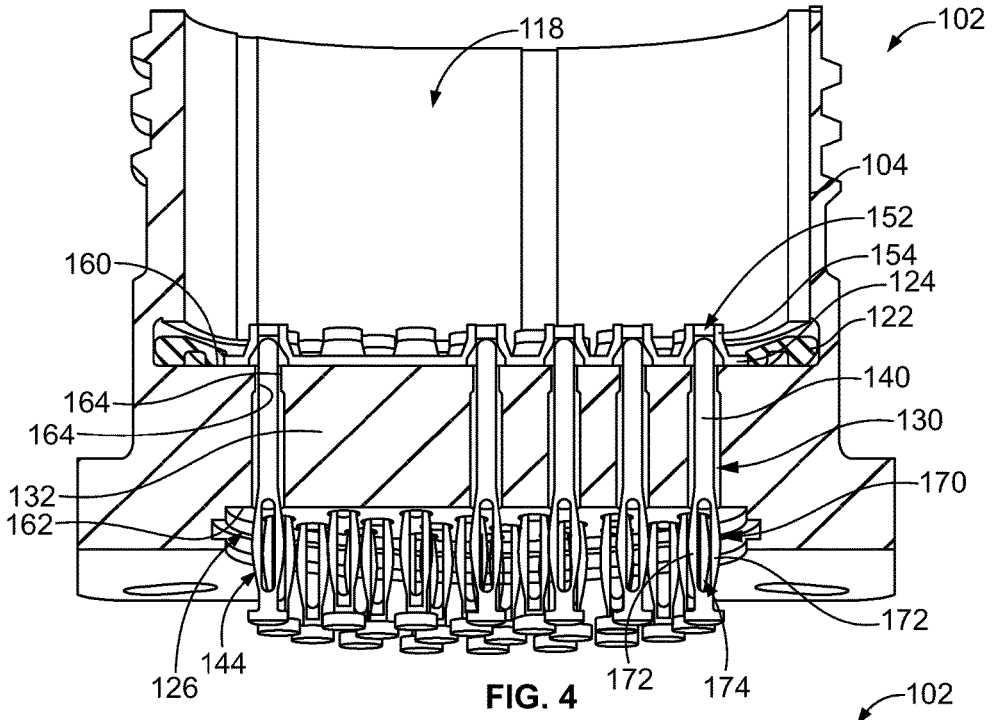
FIG. 4 is a sectional view of a portion of the grounding connector showing grounding contacts partially loaded into a shell of the grounding connector.
Figure 5:
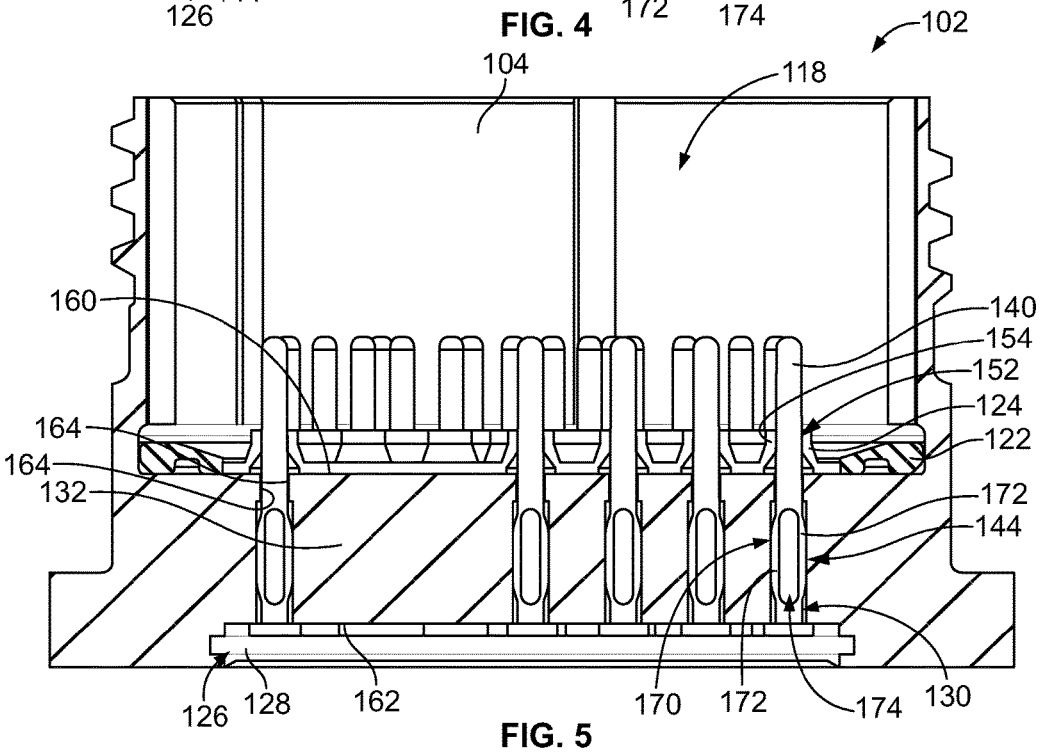
FIG. 5 is a sectional view of the grounding connector showing the grounding contacts fully loaded into the shell.

FIG. 4 is a sectional view of a portion of the grounding connector 100 showing the grounding contacts 102 partially loaded into the shell 104. FIG. 5 is a sectional view of the grounding connector 100 showing the grounding contacts 102 fully loaded into the shell 104. During assembly, the perimeter seal 122 and the interfacial seal 124 are loaded into the cavity 118 at the base 132. The seals 122, 124 may be secured in place, such as using adhesive. When assembled, the contact openings 152 are aligned with the contact channels 130. The grounding contacts 102 are shown partially loaded into the shell 104. The mating ends 140 pass through the contact channels 130 into the cavity 118. The mating ends 140 are loaded through corresponding contact openings 152 in the interfacial seal 124. In an exemplary embodiment, the interfacial seal 124 includes sealing tubes 154 configured to extend longitudinally along portions of the grounding contacts 102 and to seal to the grounding contacts 102. As such, the interfacial seal 124 may mitigate risk of galvanic corrosion between the grounding contacts 102 and the shell 104.

The base 132 includes a front 160 and a rear 162. The front 160 defines the bottom of the cavity 118. The pocket 126 is formed and the rear 162. The contact channels 130 extend entirely through the base 132 between the front 160 and the rear 162. In an exemplary embodiment, the shell 104 includes lips 164 at the front 160 that define a stepped contact channel 130. The lips 164 reduce the width of the contact channels 130 at the front 160. As such, the contact channels 130 are wider at the rear 162 of the base 132 and narrower at the front 160 of the base 132. The narrower contact channels 130 at the lips 164 are used to locate the grounding contacts 102 within the contact channels 130, such as for aligning the mating ends 140 with the contact openings 152 in the interfacial seal 124 and/or for aligning the mating ends 140 within the cavity 118 for mating with the mating component 106. The contact channels 130 are wider at the rear 162 to receive the compliant portions 144 of the grounding contacts 102.

Each compliant portion 144 includes an enlarged area 170 defined by bulged beams 172 on opposite sides of an opening 174. For example, the compliant portion defines an eye-of-the-needle pin. The bulged beams 172 are compressible or deflectable inward into the opening 174. The enlarged area 170 is initially wider than the contact channel 130 such that the bulged beams 172 interfere with the base 132 when loaded into the contact channel 130. The bulged beams 172 are deflected inward into the opening 174 by the base 132. When the bulged beams 172 are deflected inward, the bulged beams 172 are spring biased outward against the base 132 to mechanically and electrically connect the grounding contact 102 to the base 132. When assembled, the compliant portions 144 are directly supported by the shell 104. The compliant portions 144 physically engaged the shell 104 to electrically connect to the shell 104. The compliant portions 144 are press-fit into the shell 104 to quickly and reliably connect the grounding contacts 102 to the shell 104.

After the grounding contacts 102 are fully loaded into the shell 104, the rear pocket seal 128 may be provided in the pocket 126. Optionally, the rear pocket seal 128 may be an epoxy or sealant formed in place in the pocket 126, such as molded into the pocket 126. Alternatively, the rear pocket seal 128 may be pre-formed and loaded into the pocket 126. The rear pocket seal 128 provides an environmental barrier for the grounding contacts 102. As such, the rear pocket seal 128 may mitigate risk of galvanic corrosion between the grounding contacts 102 and the shell 104.

The grounding connector 100 formed using the grounding contacts 102 press-fit into the shell 104 provides a reliable, inexpensive grounding connector 100 having each of the grounding contacts 102 must together and electrically connected to the shell 104. The use of a press fit interface allows for very simple processing, reduced part complexity, simple tooling, and/or better tolerance two different plating chemistries and metals. The use of the press fit grounding contacts 102 allows for simple reconfiguration and flexibility of creating various part configurations with a simple, reusable set of components.

Figure 6:
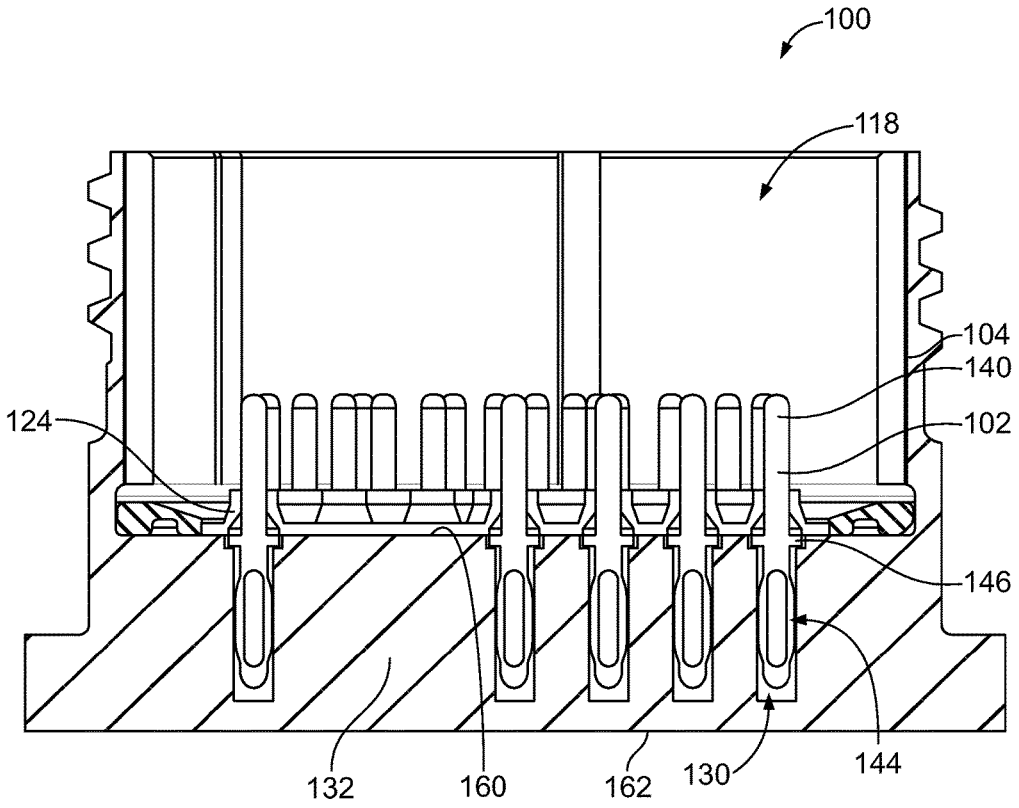
FIG. 6 is a sectional view of the grounding connector showing the grounding contacts loaded into the shell in accordance with an exemplary embodiment.

FIG. 6 is a sectional view of the grounding connector 100 showing the grounding contacts 102 front loaded into the shell 104. In the illustrated embodiment, the grounding contacts 102 are frontloaded into the shell 104 through the cavity 118 as opposed to being rear loaded into the base 132. The base 132 is closed at the rear 162. The contact channels 130 are open at the front 160 but closed at the rear 162.

The flanges 146 on the grounding contacts 102 are provided forward of the compliant portion 144. The contact channels 130 at the front 160 to receive the flanges 146. The flanges 146 may be received in the contact channels 130 in a tight fit to resist side to side movement and locate the grounding contacts 102 within the cavity 118. The compliant portions 144 are received in the narrower portions of the contact channels 130 and are mechanically and electrically connected to the base 132 within the contact channels 130. In an exemplary embodiment, the interfacial seal 124 is loaded over the mating ends 140 after the ground contacts 102 are coupled to the shell 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A grounding connector comprising:

a shell having a mating end at a front of the shell and a mounting end at a rear of the shell, the shell defining a cavity open at the mating end configured to receive a mating component, the shell having a base at the mounting end having a plurality of contact channels open to the cavity, the base having a mounting surface; and grounding contacts received in corresponding contact channels and entirely contained forward of the mounting surface, the grounding contacts having mating ends and compliant portions opposite the mating ends, the mating ends and the compliant portions forward of the mounting surface, the mating ends being positioned in the cavity for mating with the mating component, the compliant portions being received in the contact channels to mechanically and electrically connect each of the grounding contacts to the shell and to each other through the shell.

2. The grounding connector of claim 1, wherein the compliant portions are directly supported by the shell and physically engage the shell to electrically connect to the shell.

3. The grounding connector of claim 1, wherein the compliant portions are press-fit into the shell.

4. The grounding connector of claim 1, wherein the compliant portions are eye-of-the-needle pins.

5. The grounding connector of claim 1, wherein each compliant portion includes an enlarged area defined by bulged beams on opposite sides of an opening, the enlarged area initially being wider than the contact channel such that the bulged beams interfere with the base when loaded into the contact channel, the bulged beams being deflected inward into the opening such that the bulged beams are spring biased outward against the base to mechanically and electrically connect to the base.

6. The grounding connector of claim 1, wherein the grounding contacts are rear loaded through the base, the grounding contacts having flanges at rear ends of the grounding contacts engaging the base to locate the grounding contacts within the shell.

7. The grounding connector of claim 1, wherein the grounding contacts are front loaded into the base from the cavity, the grounding contacts having flanges forward of the compliant portions engaging the base to locate the grounding contacts within the shell.

8. The grounding connector of claim 1, wherein the contact channels are wider at a rear of the base and narrower at a front of the base.

9. The grounding connector of claim 1, wherein the base includes a pocket at a rear of the base, the grounding contacts being loaded into the contact channels through the pocket, the pocket being filled with a rear pocket seal after the grounding contacts are loaded into the shell.

10. The grounding connector of claim 1, wherein the shell holds an interfacial seal in the cavity at the base, the interfacial seal having contact openings aligned with corresponding contact channels, the mating ends of the grounding contacts passing through the contact openings in the interfacial seal such that the interfacial seal seals to each of the grounding contacts.

11. The grounding connector of claim 1, wherein the shell includes a cylindrical body at the mating end defining the cavity, an exterior of the cylindrical body being threaded.

12. The grounding connector of claim 1, wherein the shell has a mounting flange at the mounting end having openings configured to receive fasteners.

13. The grounding connector of claim 1, wherein the grounding contacts are machined contacts.

14. A grounding connector comprising:

a shell having a mating end at a front of the shell and a mounting end at a rear of the shell, the shell having a cylindrical body at the mating end defining a cavity open at the mating end configured to receive a mating component, an exterior of the cylindrical body being threaded, the shell having a base at the mounting end and a mounting flange extending from the base, the base having a plurality of contact channels open to the cavity, the base having a mounting surface; and grounding contacts received in corresponding contact channels and entirely contained forward of the mounting surface, the grounding contacts having mating ends and compliant portions opposite the mating ends, the mating ends and the compliant portions forward of the mounting surface, the mating ends being positioned in the cavity for mating with the mating component, the compliant portions being received in the contact channels to mechanically and electrically connect each of the grounding contacts to the shell and to each other through the shell.

15. The grounding connector of claim 14, wherein the compliant portions are directly supported by the shell and physically engage the shell to electrically connect to the shell.

16. The grounding connector of claim 14, wherein the compliant portions are press-fit into the shell.

17. A grounding connector comprising:

a shell having a mating end at a front of the shell and a mounting end at a rear of the shell, the shell defining a cavity open at the mating end configured to receive a mating component, the shell having a base at the mounting end having a plurality of contact channels open to the cavity, the base having a mounting surface, the shell holding an interfacial seal in the cavity at the base, the interfacial seal having contact openings aligned with corresponding contact channels; and grounding contacts received in corresponding contact channels and entirely contained forward of the mounting surface, the grounding contacts having mating ends and compliant portions opposite the mating ends, the mating ends and the compliant portions forward of the mounting surface, the mating ends extending forward of the base into the cavity for mating with the mating component, the mating ends passing through the contact openings in the interfacial seal such that the interfacial seal seals to each of the grounding contacts, the compliant portions being received in the contact channels to mechanically and electrically connect each of the grounding contacts to the shell and to each other through the shell.

18. The grounding connector of claim 17, wherein the compliant portions are directly supported by the shell and physically engage the shell to electrically connect to the shell.

19. The grounding connector of claim 17, wherein the compliant portions are press-fit into the shell.

20. The grounding connector of claim 1, wherein the shell only holds grounding contacts and does not hold any signal contacts.

* * * * *